US007185624B1

(12) United States Patent
Konagai et al.

(10) Patent No.: US 7,185,624 B1
(45) Date of Patent: Mar. 6, 2007

(54) FUEL INJECTION CONTROL APPARATUS OF ENGINE

(75) Inventors: Gensaku Konagai, Kanagawa (JP); Masaaki Omi, Kanagawa (JP); Tsutomu Murakami, Kanagawa (JP)

(73) Assignee: Nikki Co., Ltd. (JP)

( * ) Notice: Subject to any disclaimer, the term of this patent is extended or adjusted under 35 U.S.C. 154(b) by 0 days.

(21) Appl. No.: 11/204,349

(22) Filed: Aug. 16, 2005

(51) Int. Cl.
*F02M 7/28* (2006.01)
*F02M 51/00* (2006.01)

(52) U.S. Cl. ..... 123/195 E; 123/470; 123/435

(58) Field of Classification Search ..... 123/195 E, 123/435, 466, 468, 469, 494, 647, 470; 73/118.2, 73/119 A See application file for complete search history.

(56) References Cited

U.S. PATENT DOCUMENTS 5,771,850 A * 6/1998 Okada ..... 123/143 C
6,494,186 B1 * 12/2002 Wakeman ..... 123/479
6,712,052 B2 * 3/2004 Itoh ..... 123/647
6,725,715 B2 * 4/2004 Igarashi et al. ..... 73/204.22

FOREIGN PATENT DOCUMENTS

JP 05-001588 A 1/1993
JP 06-117316 A 4/1994

* cited by examiner

*Primary Examiner*—Hai Huynh
(74) *Attorney, Agent, or Firm*—Rader, Fishman & Grauer PLLC

(57) ABSTRACT

The invention provides a fuel injection control apparatus of an engine in which a temperature sensor for detecting an engine temperature is inexpensive and a wiring to a control unit is made unnecessary, thereby restricting a system cost low. A control unit (5) is integrally formed with a throttle chamber (3) corresponding to a peripheral device of an engine (1), a temperature sensor (6) detecting an engine temperature is directly attached to a substrate (5*b*) of the control unit (5), and the temperature sensor (6) estimates an actual engine temperature on the basis of an engine peripheral temperature detected by the temperature sensor (6) by using a correlation data obtained by previously searching a correlation between the engine peripheral temperature detected by the temperature sensor (6) and the actual engine temperature under the same condition, thereby calculating a fuel increase amount and time for the increase amount necessary from a low temperature start to a warm-up finish.

8 Claims, 3 Drawing Sheets

FUEL INJECTION CONTROL APPARATUS OF ENGINE

BACKGROUND OF THE INVENTION

1. Field of the Invention

The present invention relates to a fuel injection control apparatus which is arranged in a fuel supply system of a spark ignition type engine and electronically controls a fuel injection amount on the basis of an engine temperature.

2. Description of the Related Art

In a fuel supply system of a spark ignition type engine, in order to secure a stable rotation from a cold start of the engine to a warm-up finish, it is general to compensate so as to increase a fuel injection amount in correspondence to an engine temperature. In other words, for example, in a fuel injection control apparatus described in Japanese Unexamined Patent Publication No. 5-1588 and Japanese Unexamined Patent Publication No. 6-117316 and shown in FIG. 3, a control unit 20 determines a warm-up progress state of an engine 1 on the basis of an engine temperature detected by a water temperature sensor 11, an oil temperature sensor 12 and the like provided in the engine 1 so as to adjust a fuel injection amount of a fuel injection valve 21 in such a manner as to increase in comparison with a warm time.

However, since the water temperature sensor 11 and the oil temperature sensor 12 are directly attached to the engine 1, a protecting means such as a water proofing or the like is necessary, and since the control unit 20 is normally arranged at a position apart from the engine 1, a wiring connected to the water temperature sensor 11 and the oil temperature sensor 12 is necessary, and an output portion for outputting a signal is necessary in the sensor. Accordingly, the sensor itself becomes expensive, and an entire cost of the system tends to be expensive.

The present invention intends to solve the problem as mentioned above, and an object of the present invention is to provide a fuel injection control apparatus of an engine in which a sensor for detecting an engine temperature is inexpensive and a wiring to a control unit is made unnecessary, thereby restricting a system cost low.

SUMMARY OF THE INVENTION

In accordance with the present invention, there is provided a fuel injection control apparatus arranged in a fuel supply system of an engine and electronically controlling a fuel injection amount on the basis of an engine temperature, wherein a control unit is integrally formed with an engine peripheral device, and a temperature sensor detecting an engine temperature is directly attached to a substrate of the control unit so as to detect a peripheral temperature of the engine.

Accordingly, since the temperature sensor detecting the engine temperature is installed in the substrate of the control unit, an output portion thereof is not required, and a protecting means such as a water proofing or the like is not required, the temperature sensor becomes inexpensive, a wiring connected to the control unit is not required, and an entire of the apparatus becomes inexpensive. Further, since the engine peripheral device and the control unit are integrally formed, whereby a number of parts is reduced, an entire structure becomes compact and is easily assembled, and it is possible to restrict the system cost low.

Further, since the temperature sensor detects a temperature of the peripheral device exposed to a thermal influence of the engine, it is possible to more accurately compensate so as to increase the fuel injection amount, by recording data showing a correlation between an engine peripheral temperature detected by the temperature sensor and an actual engine temperature in a recording means of the control unit, estimating the actual engine temperature on the basis of the temperature detected by the temperature sensor by using the data, and deciding a required fuel increase amount and time for the increase amount on the basis of the engine peripheral temperature detected by the temperature sensor at a time of starting the engine.

Further, with respect to the fuel increase amount and/or the time for the increase amount, in the case that a compensation in correspondence to necessity is applied by estimating a warm-up state of the engine on the basis of a continuous or intermittent temperature monitoring using the temperature sensor, or estimating the warm-up condition of the engine by continuously or intermittently calculating a total of an engine speed after starting the engine, it is possible to execute a more accurate amount increase compensation meticulously in correspondence to a warm-up progress state.

Further, if the temperature sensor is constituted by a semiconductor sensor, the temperature sensor becomes compact and is easily attached to the substrate. In addition, if the engine peripheral device integrally forming the control unit is constituted by a throttle chamber arranged at a position near the engine, it is possible to indirectly detect the engine temperature more accurately on the basis of a temperature within a casing of the control unit. Further, since a throttle opening degree sensor and an intake air amount sensor can be formed close to the control unit or integrally formed with the control unit, a wiring for connecting them is made short or is not required, so that it is possible to restrict the system cost further lower.

In accordance with the present invention, since the sensor detecting the engine temperature becomes inexpensive and the wiring to the control unit is not required, it is possible to restrict the entire of the system cost low.

DESCRIPTION OF THE PREFERRED EMBODIMENTS

Figure 1:
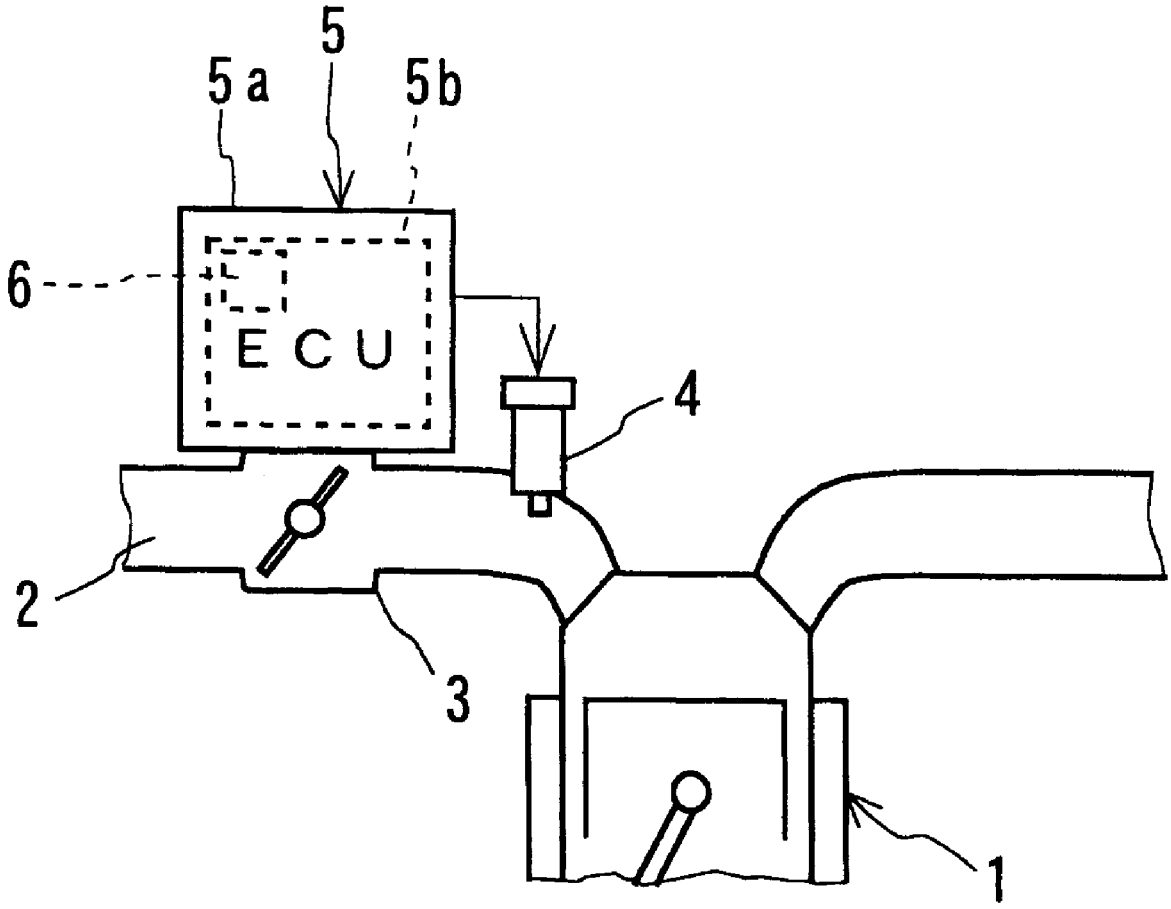
FIG. 1 is a schematic view showing an embodiment in accordance with the present invention.

A description will be given of an embodiment in accordance with the present invention with reference to the accompanying drawings. A fuel injection control apparatus in accordance with the present embodiment shown in FIG. 1 is structured such that a control unit 5 is integrally assembled in a throttle chamber 3 connected to an intake pipe 2 of an engine 1, and a temperature sensor 6 constituted by a semiconductor diode sensor is directly attached onto a substrate 5*b* thereof. In detail, the temperature sensor 6 is directly attached onto the substrate 5*b* so as to be installed in a casing 5*a* of the control unit 5, thereby indirectly detecting an engine temperature in an inner portion of the casing 5*a*.

As mentioned above, in accordance with the present embodiment in which the temperature sensor 6 is directly attached onto the substrate 5*b*, a wiring and an output portion for feeding an output signal to the control unit 5 are not required, and in accordance with the present embodiment in which the temperature sensor 6 is installed within the casing 5*a*, a protecting means such as a water proofing or the like is not required.

On the contrary, since the temperature sensor 6 is not structured such as to detect a temperature of a cooling water of the engine 1 and an engine oil, the temperature detected thereby is not an actual engine temperature. In other words, the temperature within the casing 5*a* is lower than the actual temperature of the engine 1, and some slight delay is generated in a temperature change of the engine 1.

Accordingly, as a method of accurately detecting the actual engine temperature, the actual engine temperature is estimated by searching a correlation between an engine peripheral temperature detected within the casing 5*a* under the same condition and an actual engine temperature at that time in advance so as to form data, making the correlation to be stored in ROM of the control unit 5 and using the correlation data on the basis of the engine peripheral temperature detected by the temperature sensor 6.

Further, the control unit 5 is structured such as to calculate a fuel increase amount required in addition to a normal fuel injection amount and a time of the increase amount, on the basis of the engine peripheral temperature detected at an engine start time, for keeping an engine operation from a start to a warm-up finish good, and to output a command to the fuel injection valve 4 on the basis thereof. In this case, since the casing 5*a* of the control unit 5 is integrally formed with the throttle chamber 3, it is easy to arrange a throttle opening degree sensor and an inflow air amount sensor in an inner portion of the casing 5*a* or close thereto.

Further, the control unit 5 is structured such as to always estimate a warm-up condition of the engine 1 by continuously monitoring the engine peripheral temperature by using the temperature sensor 6, and apply correction of the fuel increase amount and the time of the increase amount in correspondence to a change of the engine temperature as occasion demands. In this case, the engine peripheral temperature may be intermittently monitored in place of being continuously monitored.

Figure 2:
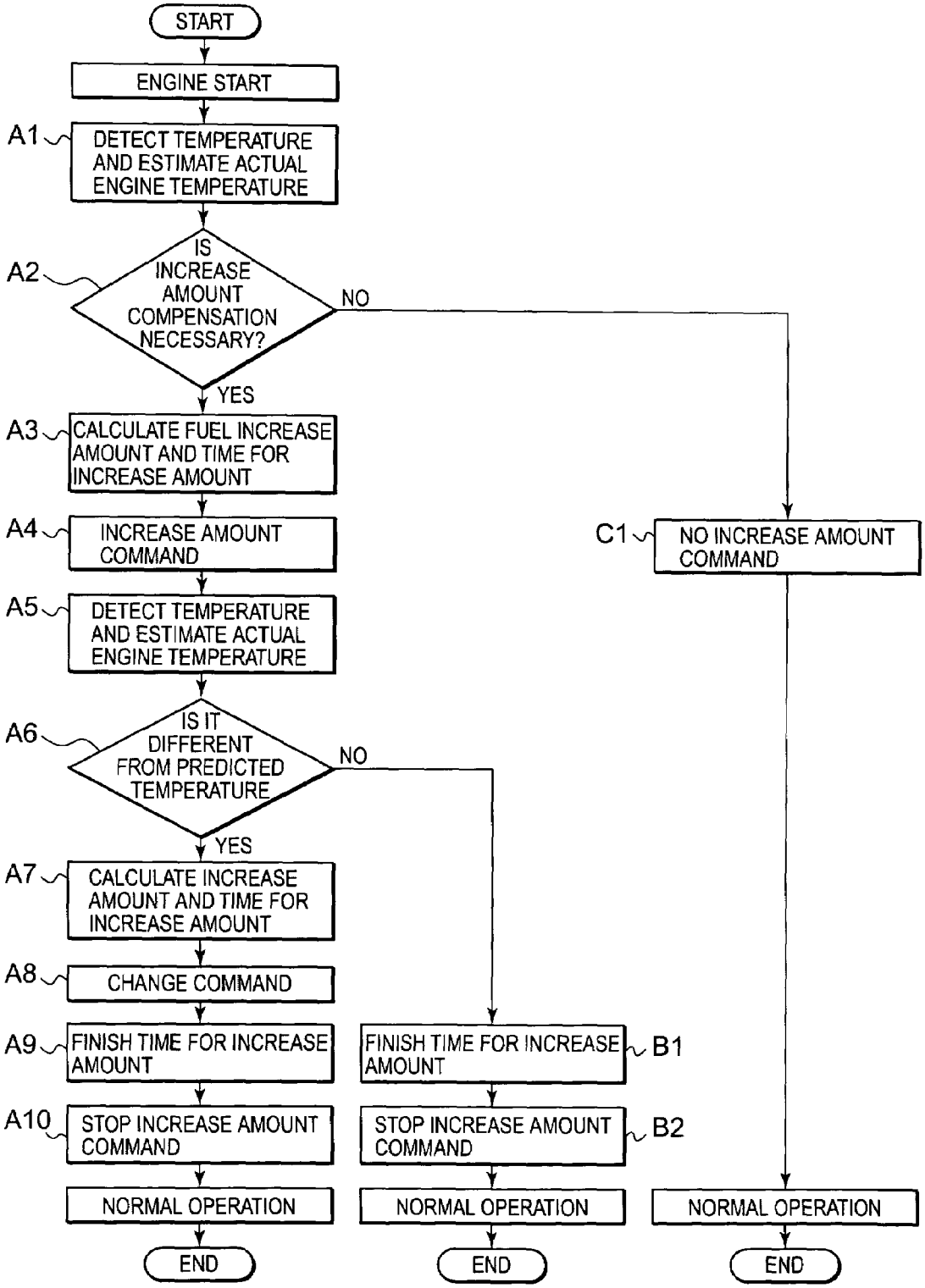
FIG. 2 is a flow chart showing a motion of a fuel injection control apparatus in FIG. 1.
Figure 3:
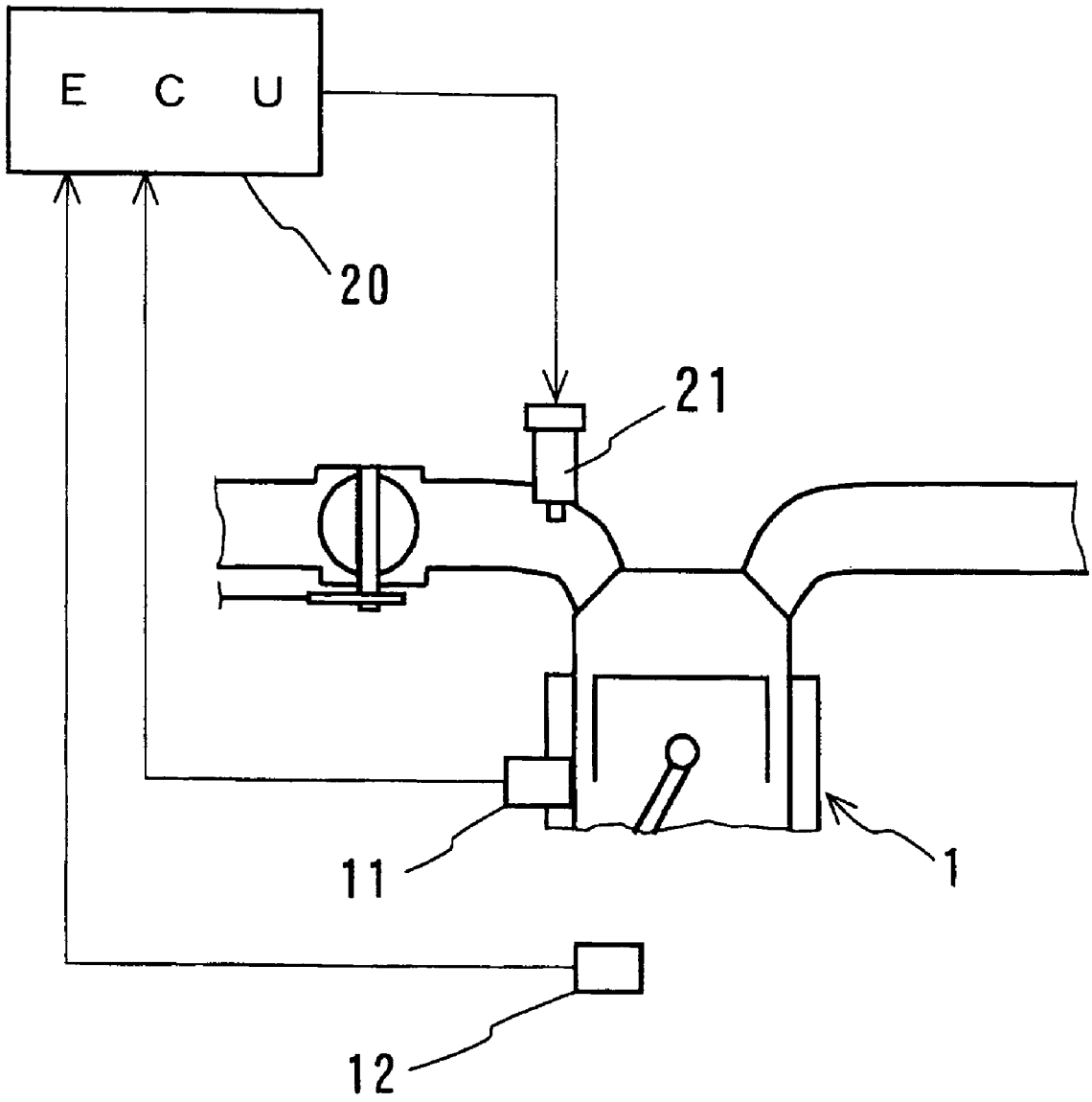
FIG. 3 is a schematic view showing a prior art.

Next, a description will be given of a motion of the fuel injection control apparatus in accordance with the present embodiment by using a flow chart shown in FIG. 2. First, the control unit 5 detects a temperature within the casing 5*a* at a start time by the temperature sensor 6 on the basis of an engine start, and estimate the actual engine temperature by using the data showing the correlation between the engine peripheral temperature corresponding to the temperature within the casing 5*a* and the actual engine temperature stored within the ROM (A1).

Further, it is determined whether or not it is necessary to compensate so as to increase a basic injection amount of the fuel at a period from the start to a warm-up finish, on the basis of the estimated actual engine temperature (A2). Further, in the case that it is determined that it is not necessary to compensate so as to increase the amount due to a sufficiently high engine temperature, that is, a warm start, a normal operation is executed without executing the increase amount command.

On the other hand, in the case that it is determined that the increase amount is necessary, that is, a cold start, the control unit 5 calculates the fuel increase amount required for keeping the engine operation good until the warm-up is finished, and the time for the increase amount (A3), executes the increase amount command on the basis of the calculated value (A4), and executes the fuel increase amount compensation for the determined time.

The increase amount and the time for the increase amount are calculated by estimating the engine temperature which ascends little by little from the start in accordance with a previously set calculating method, however, are widely different from the actual engine in accordance with various conditions in some cases, so that there is a risk that the engine operation until the warm-up is finished. Accordingly, the engine peripheral temperature is monitored in succession for a while after the engine start (A5).

Further, it is continuously determined whether or not a predicted value of the engine temperature which ascends little by little in correspondence to an elapsed time is different from the actual engine temperature in the monitoring. If they are not different, the originally determined fuel increase amount and time for the increase amount are kept, and if the determined time for the increase amount is finished (B1), the increase amount command is stopped (B2). In this case, it goes without saying that a fixed allowable range exists in determining whether or not the predicted value and the actual engine temperature are different.

On the other hand, in the case that the actual engine temperature is different from the predicted value of the engine temperature, a compensated increase amount and a compensated time for the increase amount for securing an improved operation of the engine are calculated (A7). For example, in the case that the engine temperature estimated on the basis of the detected engine peripheral temperature is lower than the predicted engine temperature, the command is changed in such a manner as to increase the increase amount or/and the time for the increase amount, and in the case of being higher, the command is changed in such a manner as to reduce (stop the increase amount in some cases) (A8). Further, if the time for the increase amount is finished (A9), the command of the increase amount is stopped (A10).

In this case, with respect to the correction of the fuel increase amount and the time for the increase amount, it is possible to employ a means for calculating the correction amount by monitoring the engine speed in succession or intermittently and calculating a total of rotating speeds from the start so as to estimate the actual engine temperature, in place of the means for monitoring the engine peripheral temperature in succession. Further, the engine peripheral device in which the control unit 5 is integrally arranged may employ the other devices than the throttle chamber 3 as far as it can faithfully reflect the engine temperature.

As described above, the fuel injection control apparatus in accordance with the present embodiment is structured such that the control unit 5 is integrally formed with the throttle chamber 3 corresponding to the engine peripheral device, and the temperature sensor 6 is arranged in the inner portion of the casing 5*a*, whereby it is possible to indirectly detect the engine temperature. Accordingly, since the protecting means such as the water proofing or the like is not required in the temperature sensor 6, and the signal output portion is not required, it is possible to make the temperature sensor inexpensive, and the wiring connected to the control unit 5 is not required, so that the entire of the apparatus becomes inexpensive. Further, since the casing 5*a* is integrally formed with the throttle chamber 3 and the number of the parts is reduced in the entire of the fuel supply system, it is easy to assemble, and it is possible to restrict the system cost low.

What is claimed is:

1. A fuel injection control apparatus arranged in a fuel supply system of an engine and electronically controlling a fuel injection amount on the basis of an engine temperature, wherein a control unit has a casing and a substrate disposed in an interior of the casing and is integrally formed with a peripheral device of said engine, and a temperature sensor is directly attached to the substrate of said control unit so as to be installed in the interior of the casing and to detect an engine peripheral temperature within the interior of the casing, the control unit is operative to control fuel injection based upon the engine peripheral temperature within the interior of the casing with correlation data stored in ROM, the correlation data is based upon data correlating detected engine peripheral temperatures and actual engine temperatures.

2. A fuel injection control apparatus as claimed in claim 1, wherein said control unit is structured such as to record data showing a correlation between an engine peripheral temperature detected by said temperature sensor and an actual engine temperature in a recording means, estimate said actual engine temperature on the basis of the engine peripheral temperature detected by said temperature sensor by using said data, and decide a required fuel increase amount and time for the increase amount on the basis of the engine peripheral temperature detected by said temperature sensor at a time of starting the engine.

3. A fuel injection control apparatus as claimed in claim 1, wherein said control unit is structured such as to record data showing a correlation between an engine peripheral temperature detected by said temperature sensor and an actual engine temperature in a recording means, estimate said actual engine temperature on the basis of the engine peripheral temperature detected by said temperature sensor by using said data, and decide a required fuel increase amount and time for the increase amount on the basis of a value obtained by applying a compensation in correspondence to necessity by estimating a warm-up state of said engine on the basis of a continuous or intermittent temperature monitoring using said temperature sensor to the engine peripheral temperature detected by said temperature sensor at the engine start time.

4. A fuel injection control apparatus as claimed in claim 1, wherein said control unit is structured such as to record data showing a correlation between an engine peripheral temperature detected by said temperature sensor and an actual engine temperature in a recording means, estimate said actual engine temperature on the basis of the engine peripheral temperature detected by said temperature sensor by using said data, and decide a required fuel increase amount and time for the increase amount on the basis of a value obtained by applying a compensation in correspondence to necessity by calculating a total of engine speeds after starting said engine in succession or intermittently to the engine peripheral temperature detected by said temperature sensor at the engine start time.

5. A fuel injection control apparatus as claimed in claim 1, 2, 3 or 4, wherein said temperature sensor is constituted by a semiconductor sensor.

6. A fuel injection control apparatus as claimed in claim 5, wherein said peripheral device is constituted by a throttle chamber.

7. A fuel injection control apparatus as claimed in claim 1, 2, 3, or 4, wherein said peripheral device is constituted by a throttle chamber.

8. A fuel injection control apparatus as claimed in claim 1, wherein said temperature sensor is a semiconductor diode sensor.

* * * * *